United States Patent [19]

Puchois

[11] 3,950,806

[45] Apr. 20, 1976

[54] MOORING BUOY

[76] Inventor: Gilbert F. Puchois, 83, rue Florent Evrard, 59162 Ostricourt, France

[22] Filed: June 26, 1974

[21] Appl. No.: 483,104

[30] Foreign Application Priority Data

June 27, 1974 France ..... 74.24485

[52] U.S. Cl. ..... 9/8 R; 114/230

[51] Int. Cl.[2] ..... B63B 21/52

[58] Field of Search ..... 9/8 R; 114/230

[56] References Cited

UNITED STATES PATENTS

| | | | |
|---|---|---|---|
| 1,958,535 | 5/1934 | Elliott | 9/8 R |
| 2,381,394 | 8/1945 | Beach | 9/8 R |
| 2,666,934 | 1/1954 | Leifheit | 114/230 |
| 3,084,354 | 4/1963 | Lumenschloss | 9/8 R |

FOREIGN PATENTS OR APPLICATIONS

| | | | |
|---|---|---|---|
| 1,525,028 | 5/1968 | France | 9/8 R |

*Primary Examiner*—Trygve M. Blix
*Assistant Examiner*—Gregory W. O'Connor
*Attorney, Agent, or Firm*—Miller, Frailey & Prestia

[57] ABSTRACT

An improved mooring buoy is provided having means for maintaining the shackle at the upper end of its hawser above water level when the buoy is at rest in the water. The buoy is provided with a floating body having a generally vertical passage extending therethrough. The lower end of the hawser is shackled to a weighted line, such as a chain, which is connected to a dead weight. Both the weighted line and the hawser are slidable freely through the passage relative to the floating body of the buoy. Means are provided for limiting the downward sliding movement of the hawser relative of the floating body, to thereby maintain the upper end of the hawser above the water level. The buoy also may be provided with a skirt extending below the floating body to a depth sufficient to terminate below the usual level of the ship's propeller, to prevent the propeller from becoming entangled in the submerged weighted line.

10 Claims, 4 Drawing Figures

MOORING BUOY

This invention relates to a mooring buoy connectable to a dead weight by a submerged weighted line such, for example, as a chain or cable and usually connected by a mooring means such, for example, as a hawser to a ship.

To moor a floating ship it is usual to employ a dead weight to which is fastened a weighted line, generally a chain, whereof the upper end is connected to a floating buoy to which is frapped a non-metallic cable such as a hawser. The hawser terminates in a shackle and, when mooring is being effected, the hawser is passed through a fair lead on the ship and the shackle is fixed to a cleat on the deck of the ship. Consequently, when a ship is not moored to the dead weight the hawser lies in the water where it becomes covered with weeds and soiled with the oily water from ports or harbours, and its unattached end is free to drift with consequent risk of being snarled in the propellor of a passing ship. This is well known to both amateur and professional sailors.

Another disadvantage with this form of mooring is that, at the instant when one wishes to effect mooring, it is essential to have a certain skill or dexterity which is perhaps the prerogative of professionals but rarely of amateurs. Indeed, it is necessary for the crew to be provided with a boat hook or similar device so that a crew member can lean outboard and catch, at the right instant, the end of the hawser (which is lying in the water) so as to fix it promptly to the cleat. The manoeuvre is a delicate one since if one misses there is risk of an accident. Moreover, the hawser, when it is recovered, is disagreeable to handle since it is oily and wet.

This problem has been partially remedied by providing handles on the buoy; but here again it is necessary to be skillful to seize the buoy and then the hawser.

It is an object of the present invention to overcome the aforesaid disadvantages.

According to the present invention there is provided a mooring buoy for a ship comprising a mooring means connected directly to a weighted line such that both are freely slidable relative to the buoyant part of the buoy, a means for arresting such sliding movement so that the upper end of the mooring means is maintained, when the buoy is in the water, at a predetermined height above the water to facilitate catching thereof from a ship and gripping means surmounting the buoy and located in the region of the upper end of the mooring means. The buoy may be provided with means adapted to be submerged in the water below the buoyant part of the buoy and below the usual level of a ship's propeller at a depth sufficient for the said means to prevent the propeller from becoming entangled in the submerged weighted line.

The mooring means is preferably a hawser terminating at its top in a shackle while the weighted line is a chain, both being vertically slidable in a tube provided in the centre of the buoyant part of the buoy, the shackle being unable to enter the tube projecting a sufficient height above the water to be within easy reach of the crewman.

In another embodiment the mooring means is simply an extension of the weighted line and terminates at its upper end in a shackle. Moreover the gripping means of the buoy may be constituted by a circular handle placed at the upper end of the tube.

According to a preferred embodiment the buoy is consituted by a cylindrical sleeve whereof an upper part comprises holes forming a handle while a lower part contains and protects the buoyant part of the buoy which is traversed axially by the mooring means sliding in a tube of such a diameter that the shackle at the upper end of the mooring means is unable to enter same, and rests concealed in the upper part of the buoy at the level of the handles.

The buoyant part of the buoy may be constituted by an inflated chamber or by a block of material having a density less than 1.

The tube may be slidable longitudinally, that is to say generally vertically, in the buoyant part and may be immobilised by means provided for this purpose when its extended height above water level provides easy reach for a crewman and, for this purpose, the buoyant part of the buoy may carry a tightening and immobilising band which can be tightened, for example, by a screw arrangement to secure the tube in extended position.

The buoyant part of the buoy may be externally surrounded by a vertically depending cylindrical skirt coaxial with the tube and of such a length that it extends below water level to a depth greater than that of a ship's propeller, the said skirt and the remainder of the buoy floating in the water in the manner of a bell and the skirt presenting at its upper part means, such as holes, for evacuating air.

The advantages of the buoys according to the invention include:

a. when a ship is not moored the submerged weighted chain descends vertically under the buoy so that there is no longer any line which might be snarled in the propeller or rudder of a ship more especially since a propeller or rudder will tend to abut against the skirt so as to push the buoy away,
b. if the hawser is formed of textile fibres it is held in the axial tube of the buoy and is maintained dry,
c. if the top of the tube of the buoy presents a handle the maneouvre of gripping same is rapid and sure; this advantage exists even in the absence of a handle since the shackle of the hawser is within easy reach.

Embodiments of the present invention will now be described, by way of example, with reference to the accompanying drawings, in which.

Figure 1:
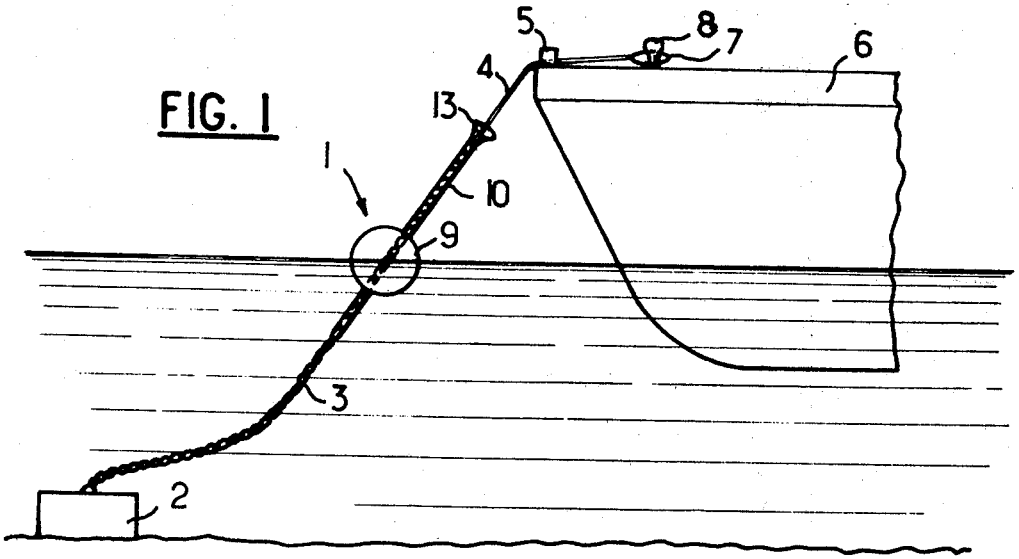
FIG. 1 is a schematic elevational view showing a buoy according to the invention with its dead weight and with a ship moored thereto.

The buoy is generally indicated by reference 1 in FIG. 1 and is connected to a dead weight 2 by a chain 3 which constitutes a weighted line, the chain 3 being extended by a hawser 4 which passes through a fair lead 5 fixed to the bow of a ship 6. The hawser 4 presents a shackle 7 which is connected to a cleat or bollard 8. The buoy 1 is constituted by a floating buoy 9 which can be hollow or inflated or even constituted by a material having a density lower than 1 and by a tube 10 which extends along the axis of the floating body 9 and which is of a diameter sufficient to allow the hawser 4, the chain 3 and the means connecting the chain 3 to the hawser 4, namely a cleat 11 and a shackle 12, freely to pass inside the tube 10. The tube 10 projects above the floating body 9 for a height of the order of 1 or 1.5 meters, for example, for buoys designed to moor pleasure ships so that a crewman can easily grasp it. This operation is facilitated by a circular handle 13 disposed at the upper end of the tube 10. Preferably, the tube 10 also extends a short distance below the floating body 9. The tube 10 is force fitted within the buoy so as to extend any desired distance above the floating body 9 for ease of grasping of the handle 13 from a boat. The shackle 7 is sufficiently large not to be able to pass into the tube 10 and remains constantly outside same above the tube. If necessary to prevent the shackle passing into the tube 10, one can provide a knot or a cable clamp (not shown) just under the shackle 7.

Figure 2:
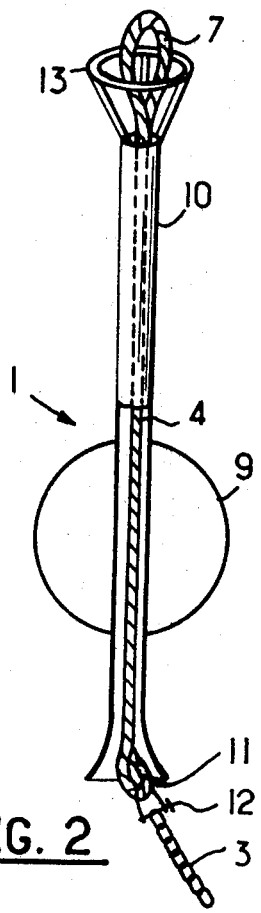
FIG. 2 is a part sectional perspective view of a first embodiment of the buoy of the invention.

To use the buoy as shown in FIGS. 1 and 2, when the ship approaches, it is sufficient to grasp the circular handle 13, then the shackle 7 and rapidly to fasten the latter on the cleat or bollard 8 by passing the hawser through the fair lead 5. The pulling effort of the ship 6 then causes the chain 3 to slide up the tube 10 and the shackle 12 can easily, if necessary, pass upwards to the level of the handle 13. It is necessary to observe that no appreciable force is applied on any part of the buoy 1. When the shackle 7 is detached from the cleat or bollard 8, the hawser 4 slides down the tube until the shackle 7 (or the knot or cable clamp) is impeded by the upper end of the tube 10 at the interior of the handle 13. In the rest position, the buoy is ballasted by the chain 3 and the tube 10 takes up a balanced vertical position.

Figure 3:
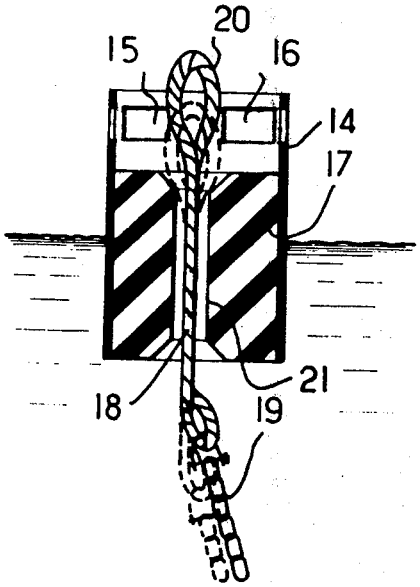
FIG. 3 is a schematic sectional view of a second embodiment of the buoy according to the invention.

In the embodiment of the buoy shown in FIG. 3, there is provided a cylindrical collar 14 which is formed of a non-oxidisable material, such as a lightweight alloy, or a sheet of plastics material, and whereof the upper part is provided with holes 15, 16 forming a handle while the lower part contains and protects a buoyant material 17 having a density lower than 1, and which is traversed axially by a hawser 18 which is an extension of a chain 190 and which has at its top a shackle 20 similar to the shackle 7. The hawser 18 slides in a tube 21 of a diameter such that the shackle 20 cannot enter therein. The shackle 20 rests concealed in the upper part of the buoy at the level of the holes 15, 16, as illustrated by the broken lines in FIG. 3. This embodiment of the buoy is particularly economical to manufacture if one employs for the collar 14 a sheet of rolled plastics material and for the buoyant material polyeurathane foam for example.

Figure 4:
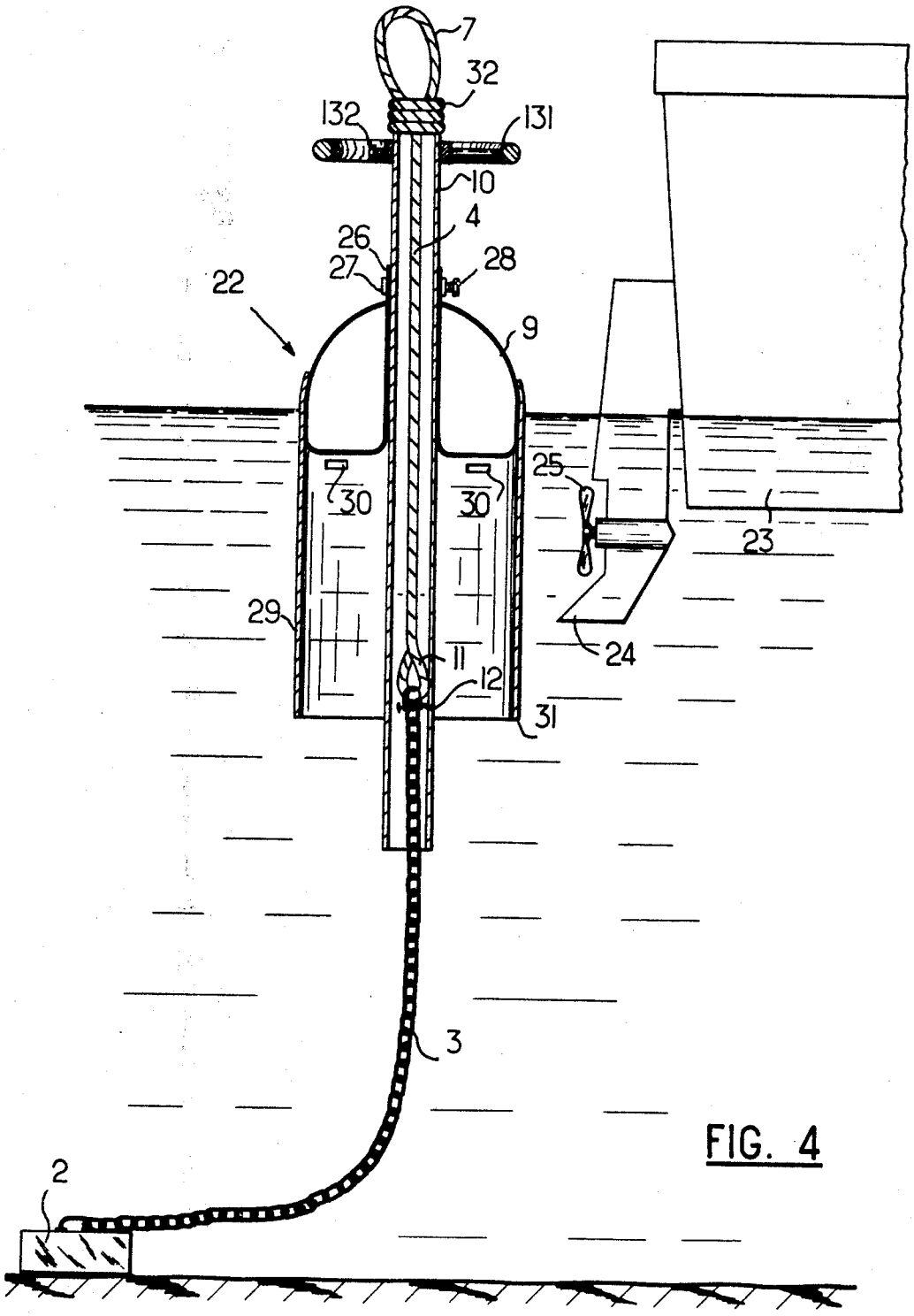
FIG. 4 is a sectional view of a third embodiment of the invention but with the buoy being provided with a skirt.

In the third embodiment shown in FIG. 4, parts similar to those shown in the embodiment of FIG. 1 are identically referenced. There is shown generally the buoy 22 connected to a dead weight 2 by a chain 3 extended by a hawser 4 passing through a tube 10 and terminating in a shackle 7. The floating body 9 has a different form but is constituted by a hollow or inflatable body, or is formed from a cellular material such as the buoy of FIG. 3. It is traversed by an axial hole permitting passage of the tube 10 which extends sufficiently below the buoy. Tube 10 has a circular handle 131 affixed to its upper end by means of a screw 132.

In this FIG. 4, there is also shown a ship 23 with its propulsion apparatus 24 including a propeller 25.

The embodiment shown in FIG. 4 has two particular features. The first resides in the fact that the tube 10 can slide longitudinally in the floating body 9 and be immobilised at a position which is judged to be the best for the shackle 7 to be easily grasped by a user. For this purpose the floating body 9 is surmounted by a tubular neck 26 which is an extension of the axial hole of this body through which passes the tube 10, the tubular neck being surrounded by a band 27 provided with a tightening screw 28 and adapted to clamp the tube 10 in extended position. It will easily be understood with this arrangement that one can secure the tube 10 at will in any desired position.

The second particular feature of the embodiment shown in FIG. 4 resides in the fact that the floating body 9 is surrounded by a cylindrical skirt 29 having at its upper part, just below the floating body 9, holes 30. The vertically depending shield on skirt 29 with the body 9 constitutes a bell which floats in the water, the air which would be stored therein escaping by the holes 30. The length of the skirt 29 is sufficient for the lower edge 31 thereof to be clearly below the propulsion apparatus 24 of the ship and in particular below the propeller 25. A major advantage of this feature is that the propeller 25 cannot interfere with the chain 3 since it will tend to strike the skirt 31, without any damage to the floating body 9 which remains intact and maintains the buoyancy of the buoy so that it pushes the buoy without causing any mutual damage being effected.

In FIG. 4, there is also shown a knot 32 or cable clamp located just below the shackle 7 and which has a diameter greater than that of the tube 10 to prevent the shackle 7 from entering the tube 10.

As best shown in FIGS. 1 and 4, it is preferred that the shackle 7 at the upper extremity of the hawser 4 be disposed at a level which is proximate the level of the deck of the ships 6, 23, when the buoys 1, 22 are at rest in the water. Further, as shown in FIGS. 1 and 4, the lower ends of the tubes 10 extend into the water, below the buoys 1, 22, to a depth below the level at which the propeller of the ship is located. Thus, the lower extension of the tube 10 serves to ballast the buoys 1, 22 so that their tubes 10 always remain generally vertical when the buoys are at rest in the water.

What we claim is:

1. In a mooring buoy having mooring means for a ship:

a. a floating body, b. a passage extending through the floating body, said passage being disposed in a generally vertical direction when the floating body is at rest in the water, c. a tube disposed within the passage, said tube having an upper end extending above the floating body and lower end extending below the floating body into the water to a depth below a propeller of the ship, said lower extension of the tube serving to ballast the buoy so that the tube remains generally vertical when the floating body is at rest in the water, d. the mooring means being disposed slidably in the tube, said mooring means being connected to a weighted line and having an upper end provided with a shackle, e. gripping means affixed to the upper end of the tube and f. means disposed proximate the gripping means for arresting the sliding movement of the mooring means relative to the tube, in the direction of the water, whereby the shackle is maintained above the water, when the buoy is not in use, g. the tube being adjustable axially within the passage, and being selectively immobilizable with its upper end disposed above the floating body at a distance sufficient to present the gripping means and shackle at a height above the water at which they can be grasped easily by a crewman.

2. A buoy as claimed in claim 1, in which the mooring means is a hawser terminating at its top in a shackle while the weighted line is a chain, both being slidable vertically in a tube provided and fixed in the centre of the floating body of the buoy, the shackle being unable to enter the tube and projecting a sufficient height above the water, when the buoy is in the water, for it to be easily grasped by a crewman.

3. A mooring buoy as claimed in claim 1, in which the mooring means is an extended portion of the weighted line and terminates at its upper end in a shackle.

4. A mooring buoy as claimed in claim 2, in which the gripping means is constituted by a circular handle disposed at the upper end of the tube.

5. A mooring buoy as claimed in claim 4 comprising an inflated chamber.

6. A mooring buoy as claimed in claim 1 comprising a block of material having density of less than 1.

7. A mooring buoy as claimed in claim 1, further including a tightening and immobilizing band on the tube, the band being tightened by a screw arrangement to secure the tube selectively in height adjusted position.

8. A mooring buoy as claimed in claim 1, in which the floating body is provided with a depending shield, said shield extending below the floating body to a depth sufficient for the shield to prevent a propeller of a ship from becoming entangled in the weighted line.

9. A mooring buoy as claimed in claim 8, in which the shield is a vertical cylindrical skirt coaxial with the tube, the skirt and the floating body floating in the water in the manner of a bell and the skirt having at its upper part means for evacuating air.

10. A mooring buoy for a ship including mooring means having an upper extremity terminating at a level proximate a deck of the ship, comprising:

a. a floating body.

b. a passage extending through the floating body, said passage being disposed in a generally vertical direction when the floating body is at rest in water, c. mooring means disposed slidably in the passage, said mooring means being connected to a weighted line and having an upper end provided with a shackle, d. a cylindrical sleeve surrounding the floating body, said cylindrical sleeve having an upper part extending above the floating body and provided with holes forming a cylindrical handle, said holes being disposed above the floating body at a distance sufficient to present the cylindrical handle at a height above the water at which said handle can be grasped easily by a crewman, and said cylindrical sleeve having a lower part extending below the floating body into the water to a depth below propellers of the ship, and e. means disposed at the upper end of the passage, within the cylindrical handle, for arresting the sliding movement of the mooring means relative to the passage, in the direction of the water, whereby the shackle rests concealed in the upper part of the buoy at the level of the handle when the buoy is not in use.

* * * * *

UNITED STATES PATENT OFFICE

CERTIFICATE OF CORRECTION

PATENT NO. : 3,950,806

DATED : April 20, 1976

INVENTOR(S) : Gilbert F. Puchois

It is certified that error appears in the above-identified patent and that said Letters Patent are hereby corrected as shown below:

Page 1, line [30] change the Foreign Application Priority Date from "June 27, 1974" to ---June 27, 1973---

Column 2, line 21 - after "skirt" insert ---or shield---

Column 4, line 12 - change "on" to ---or---

Column 4, line 48 - after "and" insert ---a---

Column 5, line 17 - change "4" to ---1---

Column 5, line 20 - after "having" insert ---a---

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*